US008355647B2

(12) United States Patent
Ootsuka

(10) Patent No.: US 8,355,647 B2
(45) Date of Patent: Jan. 15, 2013

(54) ELECTRONIC DEVICE AND IMAGE FORMING APPARATUS

(75) Inventor: Yuji Ootsuka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 444 days.

(21) Appl. No.: 12/506,586

(22) Filed: Jul. 21, 2009

(65) Prior Publication Data

US 2010/0150599 A1 Jun. 17, 2010

(30) Foreign Application Priority Data

Dec. 12, 2008 (JP) ..... 2008-316725

(51) Int. Cl.
*G03G 15/00* (2006.01)

(52) U.S. Cl. ..... 399/81; 399/91

(58) Field of Classification Search ..... 399/81, 399/91, 92

See application file for complete search history.

(56) References Cited

U.S. PATENT DOCUMENTS

2006/0029417 A1* 2/2006 Kawamata et al. ..... 399/91
2006/0288331 A1 12/2006 Asakawa
2007/0268321 A1* 11/2007 Kawamata ..... 347/15

FOREIGN PATENT DOCUMENTS

JP 2002-226074 8/2002
JP 2006 072200 A 3/2006
JP 2006 343393 A 12/2006

OTHER PUBLICATIONS

JP 2006-072200 English machine translation.*

* cited by examiner

*Primary Examiner* — Walter L Lindsay, Jr.
*Assistant Examiner* — Roy Y Yi
(74) *Attorney, Agent, or Firm* — Morgan, Lewis & Bockius LLP

(57) ABSTRACT

An electronic device includes: a display that displays at least a status of the device; a controller that is provided on a back surface of the display and controls a display on the display; a heat source; a shield that shields the controller from the heat source; and an opening that is connected to a space formed by the controller and the shield and allows air outside the device to flow in and out of the controller.

9 Claims, 5 Drawing Sheets

ELECTRONIC DEVICE AND IMAGE FORMING APPARATUS

CROSS-REFERENCE TO RELATED APPLICATIONS

This application is based on and claims priority under 35 USC 119 from Japanese Patent Application No. 2008-316725 filed Dec. 12, 2008.

BACKGROUND

Technical Field

The present invention relates to an electronic device and an image forming apparatus.

SUMMARY

According to an aspect of the invention, there is provided an electronic device including: a display that displays at least a status of the device; a controller that is provided on a back surface of the display and controls a display on the display; a heat source; a shield that shields the controller from the heat source; and an opening that is connected to a space formed by the controller and the shield and allows air outside the device to flow in and out of the controller.

BRIEF DESCRIPTION OF THE DRAWINGS

Exemplary embodiments of the present invention will be described in detail based on the following figures, wherein:

FIGS. 4A to 4C illustrate the periphery of a control panel cover for an image forming apparatus according to a second exemplary embodiment of the invention, wherein FIG. 4A is a schematic configuration diagram, seen from the front, of the apparatus, FIG. 4B is a sectional side view of the apparatus according to a first specific example, and FIG. 4C is a sectional side view of the apparatus according to a second specific example; and FIGS. 5A to 5C illustrate the periphery of a control panel cover for an image forming apparatus according to a third exemplary embodiment of the invention, wherein FIG. 5A is a schematic configuration diagram, seen from the front, of the apparatus, FIG. 5B is a sectional side view of the apparatus according to a third specific example, and FIG. 5C is a sectional side view of the apparatus according to a fourth specific example.

DETAILED DESCRIPTION

Hereinafter, exemplary embodiments of the present invention will be described with reference to the accompanying drawings.

Figure 1:
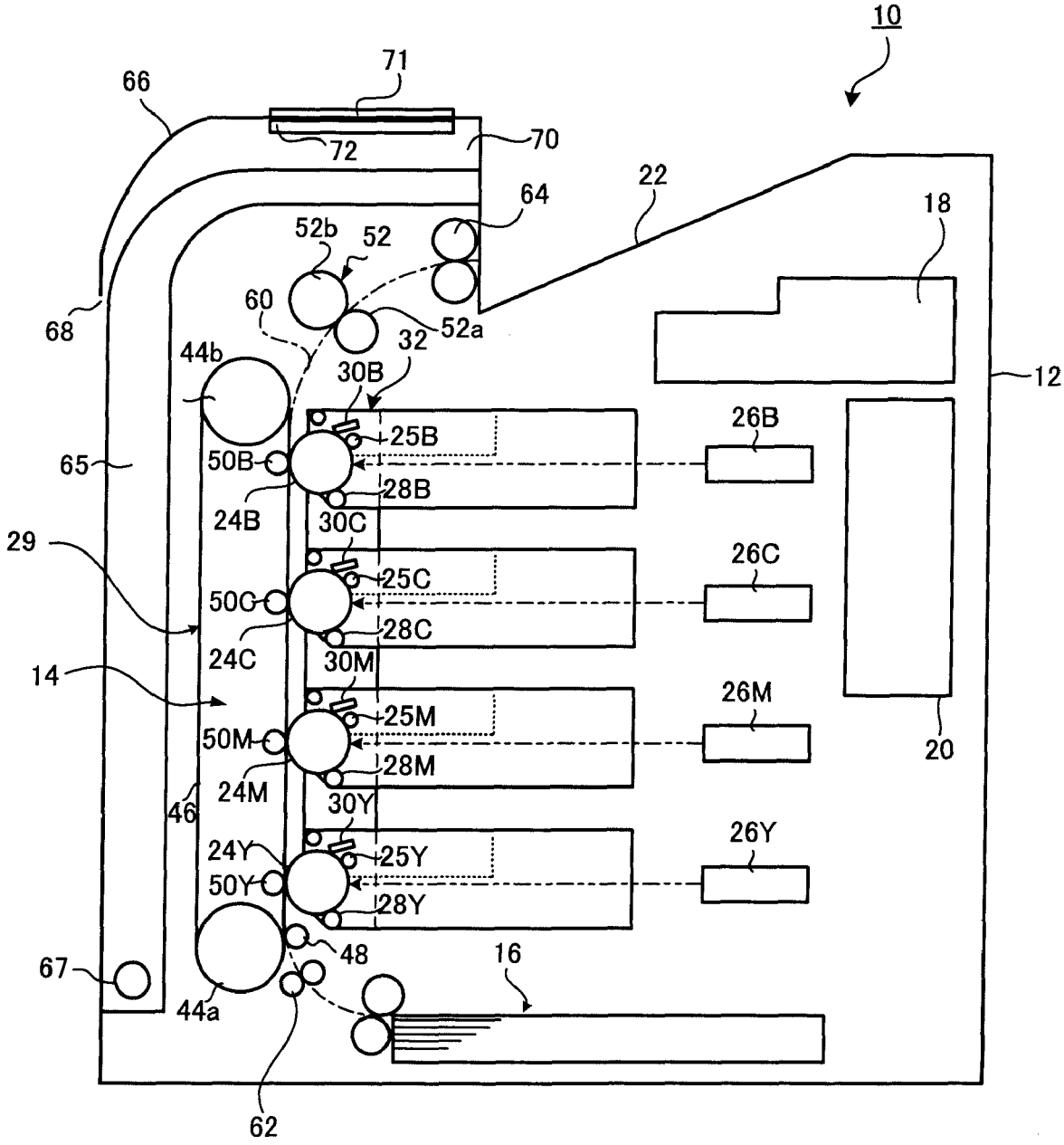
FIG. 1 is a schematic sectional view, viewed from the side, of an image forming apparatus according to an exemplary embodiment of the invention.
Figure 2:
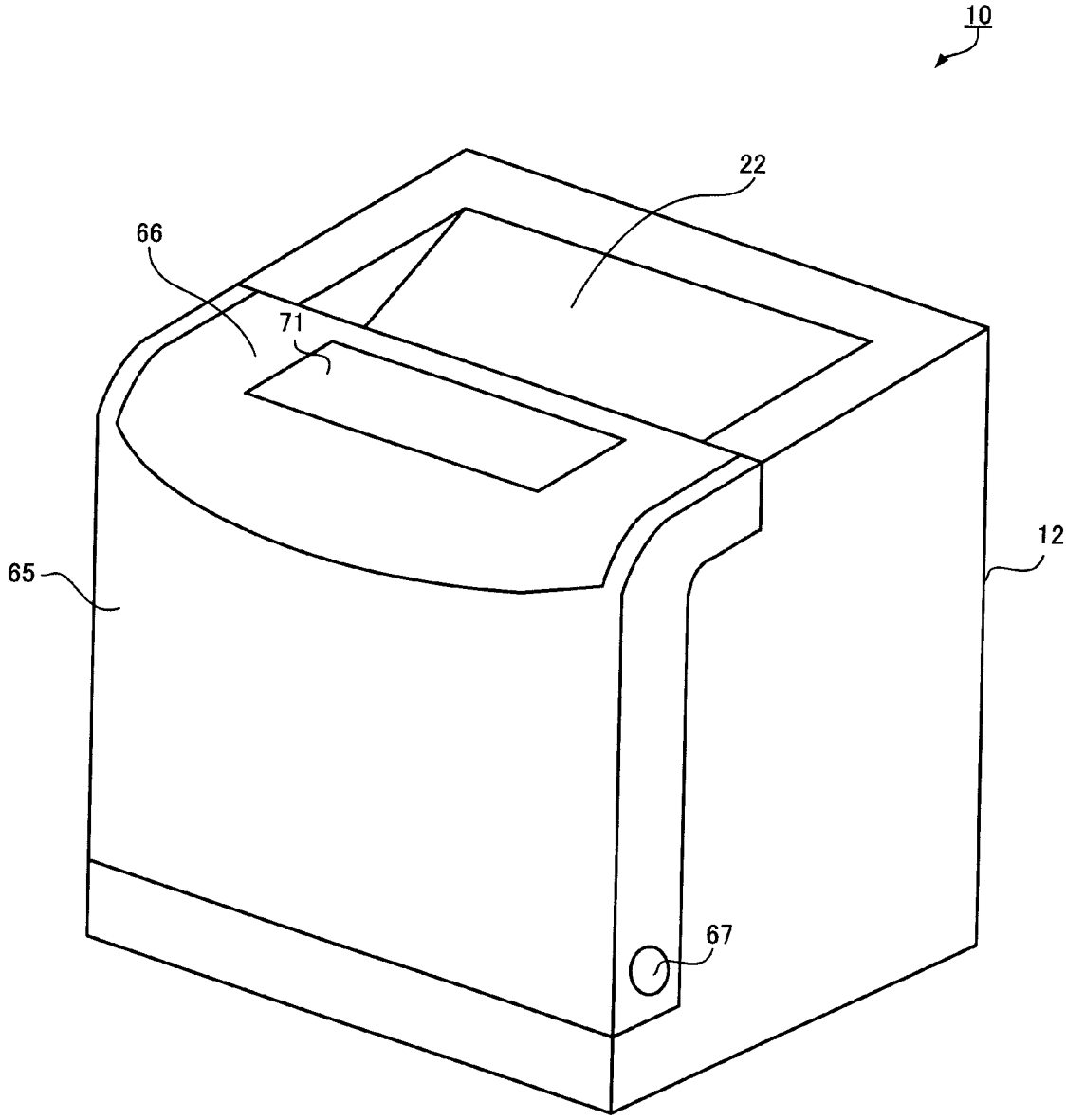
FIG. 2 is a perspective view showing the image forming apparatus according to the exemplary embodiment of the invention.

FIGS. 1 and 2 illustrate schematically an image forming apparatus 10 as an example of an electronic device according to an exemplary embodiment of the invention. The image forming apparatus 10 includes an image forming apparatus main body 12. In the apparatus main body 12, there are provided an image forming part 14, a sheet feeding device 16 for feeding sheets to the image forming part 14, a power supply unit 18, and a controller 20 having a CPU (Central Processing Unit) and the like. The controller 20 controls respective components composing the image forming apparatus 10. Also, a sheet discharging part 22 for discharging sheets subjected to image formation is provided above the apparatus main body 12.

The image forming part 14 adopts an electrophotographic system for forming a color image, and includes: image holders 24Y, 24M, 24C, and 24B for holding toner images; electrification devices 25Y, 25M, 25C, and 25B with charging rollers for uniformly electrically-charging the respective image holders 24Y, 24M, 24C, and 24B; optical writing devices 26Y, 26M, 26C, and 26B for optically writing electrostatic images on the respective image holders 24Y, 24M, 24C, and 24B; developing devices 28Y, 28M, 28C, and 28B for developing latent images written on the respective image holders 24Y, 24M, 24C, and 24B using a developer of a two-component system composed of a nonmagnetic toner and a magnetic carrier; a transfer unit 29 for transferring the toner images formed on the respective image holders 24Y, 24M, 24C, and 24B on a sheet; and cleaning devices 30Y, 30M, 30C, and 30B for recovering by, for example, scraping or stripping off the waste toner remaining on the image holders 24Y, 24M, 24C, and 24B after the transfer of the toner images using the transfer unit 29.

Each of the optical writing devices 26Y, 26M, 26C, and 26B is made up of a laser exposure machine. The optical writing device 26Y emits a laser beam corresponding to a yellow image onto the image holder 24Y; the optical writing device 26M emits a laser beam corresponding to a magenta image onto the image holder 24M; the optical writing device 26C emits a laser beam corresponding to a cyan image onto the image holder 24C; and the optical writing device 26B emits a laser beam corresponding to a black image onto the image holder 24B, for writing the respective electrostatic images on the image holders 24Y, 24M, 24C, and 24B.

The transfer unit 29 is provided in contact with the image holders 24Y, 24M, 24C, and 24B of an image forming unit 32. The transfer unit 29 integrated as a unit is provided with two support rollers 44*a* and 44*b*, a conveyance belt 46 for conveying a sheet or a toner image, an attachment roller 48 for attaching the sheet to the conveyance belt 46, and transfer rollers 50Y, 50M, 50C, and 50B for transferring the respective toner images formed on the image holders 24Y, 24M, 24C, and 24B onto the sheet being conveyed with the conveyance belt 46.

The attachment roller 48 is provided in press-contact with the support roller 44*a* through the conveyance belt 46. The attachment roller 48 receives a voltage applied from the power supply unit 18 to electrostatically attach the sheet to the conveyance belt 46.

A transfer bias is applied to the respective transfer rollers 50Y, 50M, 50C, and 50B, to sequentially transfer the toner images formed on the image holders 24Y, 24M, 24C, and 24B onto the sheet being conveyed with the conveyance belt 46, thereby forming a color toner image with four color toner images, i.e., yellow, magenta, cyan and black toner images superimposed.

A fixing device 52 to fix the toner image transferred on the sheet by the transfer unit 29 onto the sheet is provided in an upper portion of the apparatus main body 12. The fixing device 52, composed of a heating roller 52*a* and a pressure roller 52*b*, fixes the toner image onto the sheet by heating and pressing the sheet passing between the heating roller 52*a* and the pressure roller 52*b*.

Furthermore, a conveyance path 60 for conveying a sheet supplied from the sheet feeding device 16 to the sheet discharging part 22 is provided in the apparatus main body 12. Along the conveyance path 60, a registration roller 62, the transfer unit 29, the fixing device 52, and a discharge roller 64 are provided sequentially from the upstream side of a sheet conveyance direction. The discharge roller 64 discharges the sheet conveyed from the fixing device 52 to the sheet discharging part 22.

An opening and closing cover 65 is mounted from the front face to an upper face of the apparatus main body 12 (the left side in FIG. 1).

The opening and closing cover 65 is openable and closable about a hinge 67 provided on a front lower portion of the apparatus main body 12. By closing the opening and closing cover 65, the inside of the apparatus main body 12 is sealed.

A control panel cover 66 is mounted from the upper face to a front face of the opening and closing cover 65 (the upper side in FIG. 1).

A display 71 is provided on a surface of the control panel cover 66 for displaying a status of the image forming apparatus 10.

A control substrate 72 as a controller for controlling a display on the display 71 is provided on a back surface of the control panel cover 66, corresponding to the back surface of the display 71.

Figure 3:
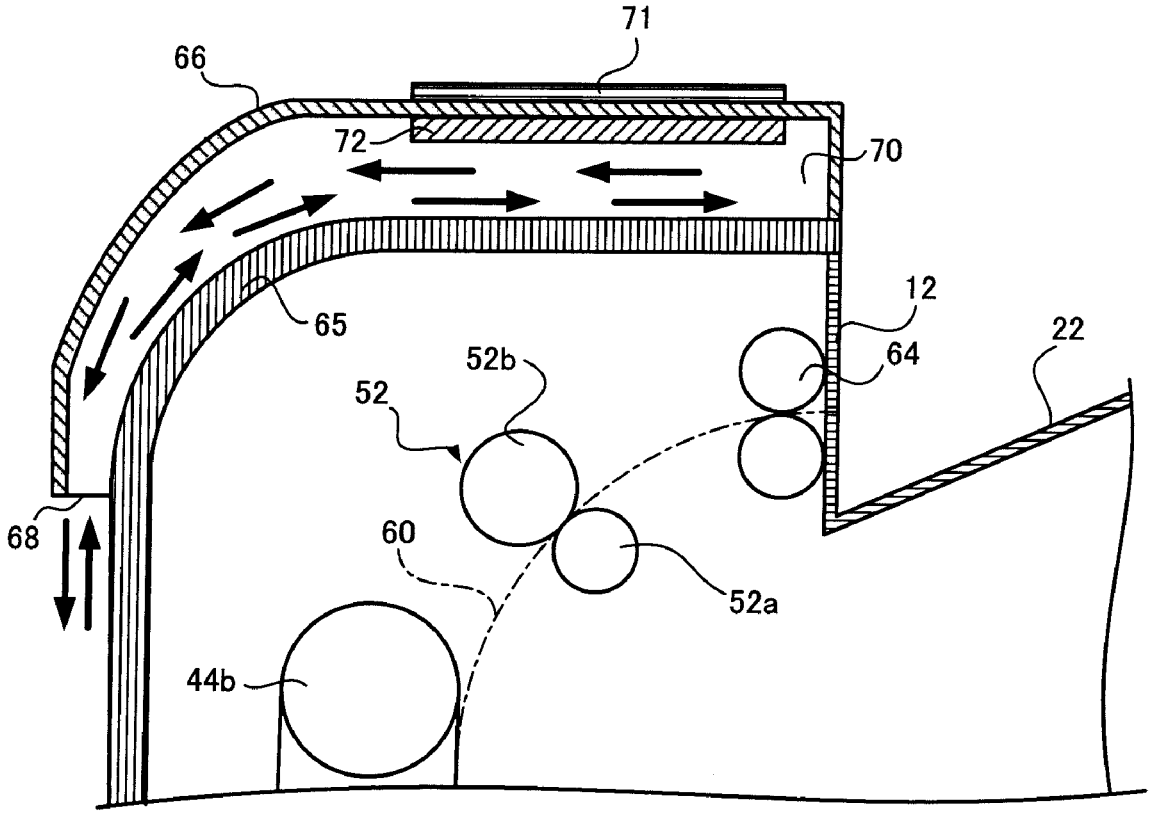
FIG. 3 is a sectional view, viewed from the side, showing the periphery of a control substrate according to the exemplary embodiment of the invention.

FIG. 3 is a detail sectional view showing the periphery of the control substrate 72.

The control panel cover 66 is mounted to overlap the opening and closing cover 65, from an upper portion to a front face of the cover 65.

Therefore, an opening 68 for allowing outside air to flow in and out is formed between the opening and closing cover 65 on the front side of the apparatus main body 12 (the left side in FIG. 3) and an end of the control panel cover 66.

The opening 68 is formed downwardly in the direction of gravitational force, and therefore is not easily visible from the front of the apparatus main body.

Also, the opening 68 has a size such that, for example, a finger (about 5.6 mm in diameter) cannot be inserted therein.

Between the control substrate 72 provided on the back surface of the control panel cover 66, and the surface of the opening and closing cover 65, there is formed a clearance 70 made up of the back surface of the control panel cover 66, the surface of the opening and closing cover 65, and the opening 68. In other words, the control substrate 72 is shielded from the fixing device 52 as a heat source by the opening and closing cover 65, and is placed in a space different from the fixing device 52.

Furthermore, the opening 68 communicates with the clearance 70, and is formed so that outside air flows in and out of the clearance 70. Thus, the clearance 70 serves as an air inflow path for the air inflowing from the opening 68, and an air outflow path for the air flowing out of the opening 68.

That is to say, according to this exemplary embodiment of the present invention, the control substrate 72 is shielded from the fixing device 52 as a heat source, and the clearance 70 serving as the air inflow/outflow path is provided between the control substrate 72 and the opening and closing cover 65 as a shield to place the control substrate 72 in the clearance 70, thereby naturally cooling the control substrate 72.

Figure 4A:
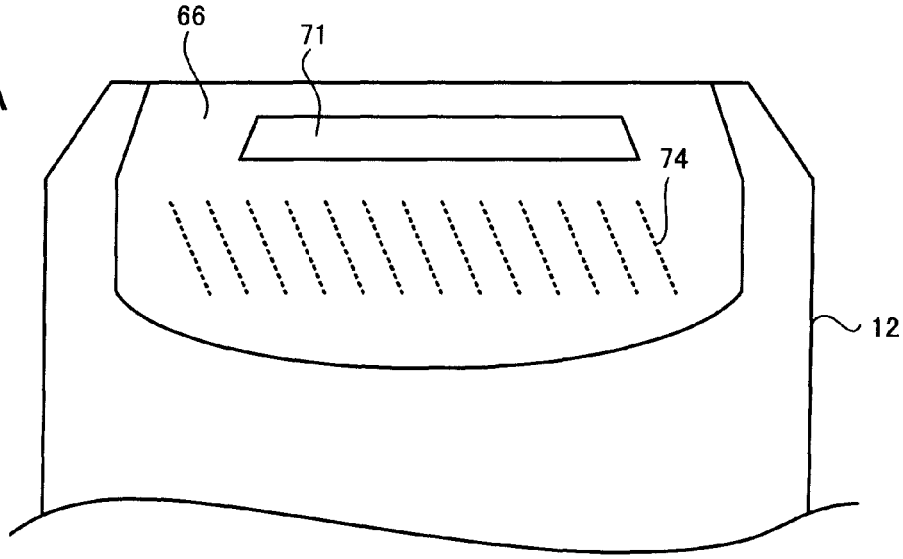
Figure 4B:
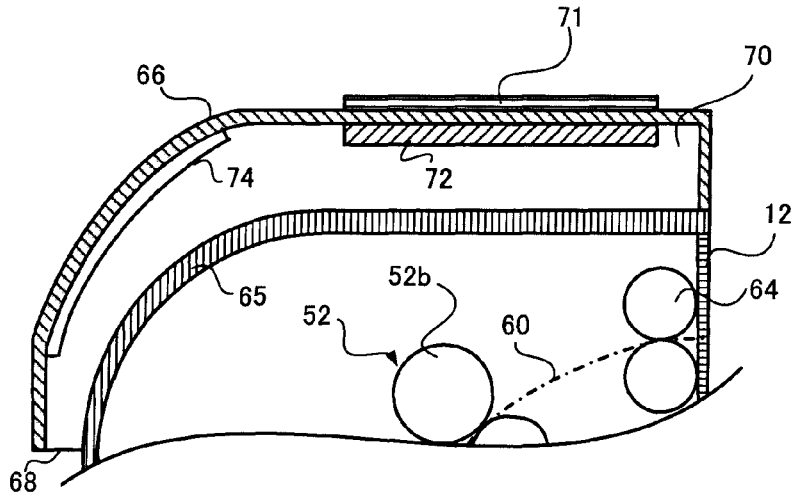
Figure 4C:
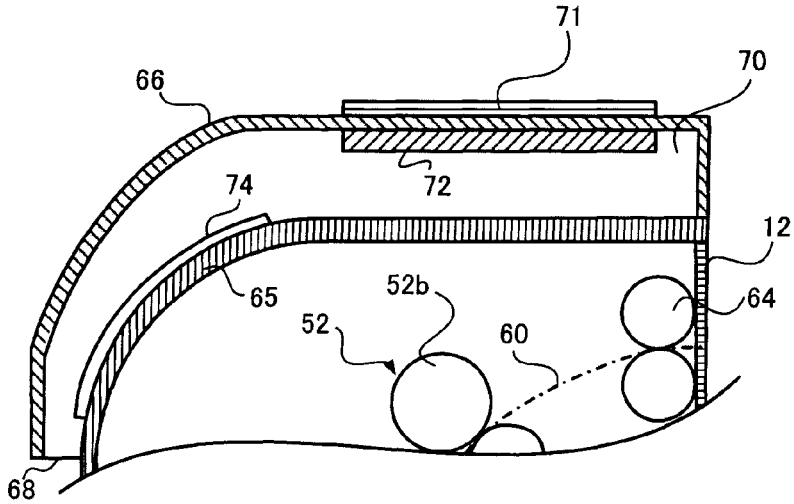

FIGS. 4A to 4C illustrate the periphery of the control panel cover 66 for the image forming apparatus 10 according to a second exemplary embodiment of the invention. FIG. 4A is a schematic configuration diagram, seen from the front, of the apparatus, FIG. 4B is a sectional side view of the apparatus according to a first specific example, and FIG. 4C is a sectional side view of the apparatus according to a second specific example.

As shown in FIG. 4B, according to the first specific example, a projecting part projecting toward the opening and closing cover 65, for example, the rib 74 is plurally formed, between the opening 68 provided in the clearance 70, and the control substrate 72, on a back surface of the control panel cover 66. The ribs 74 may be formed obliquely with respect to the opening 68.

Alternatively, as shown in the second specific example of FIG. 4C, the plural ribs 74 projecting toward the control panel cover 66 can be formed, between the opening 68 provided in the clearance 70 and the control substrate 72, on a surface of the opening and closing cover 65.

Alternatively, by combination of FIGS. 4B and 4C described above, both on a back surface of the control panel cover 66 provided in the clearance 70 and on a surface of the opening and closing cover 65, the plural ribs 74 projecting toward the other may be formed.

In addition, the plural ribs 74 may be provided with the spacing such that a finger (about 5.6 mm in diameter) cannot be inserted therein.

Figure 5A:
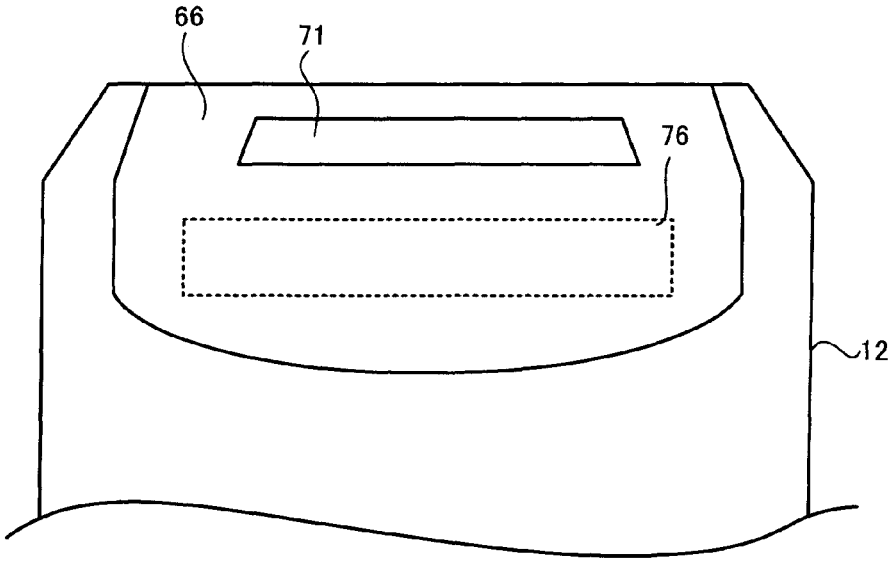
Figure 5B:
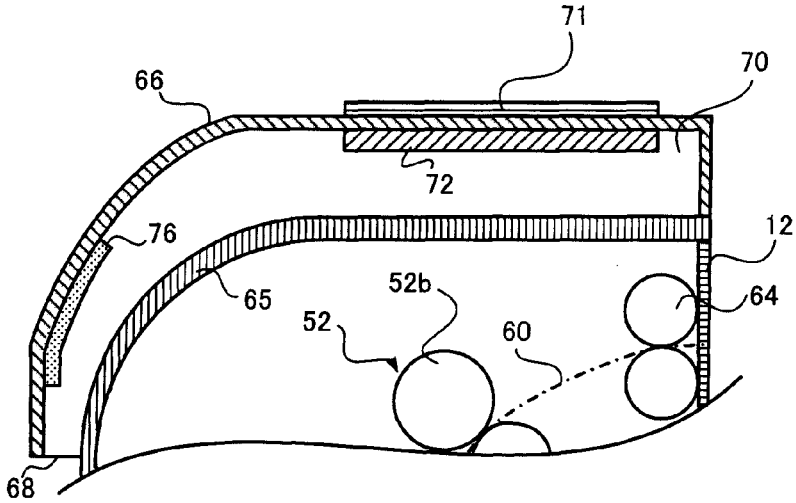
Figure 5C:
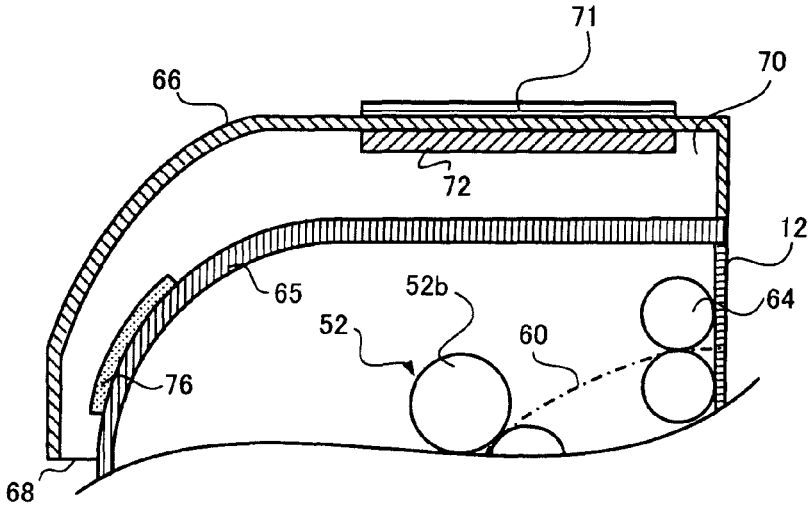

FIGS. 5A to 5C illustrate the periphery of the control panel cover 66 for the image forming apparatus 10 according to a third exemplary embodiment of the invention. FIG. 5A is a schematic configuration diagram, seen from the front, of the apparatus, FIG. 5B is a sectional side view of the apparatus according to a third specific example, and FIG. 5C is a sectional side view of the apparatus according to a fourth specific example.

As shown in FIG. 5B, according to the third specific example, an antistatic cloth 76 is provided, between the opening 68 provided in the clearance 70 and the control substrate 72, on a back surface of the control panel cover 66.

Alternatively, as shown in the fourth specific example of FIG. 5C, the antistatic cloth 76 can be provided, between the opening 68 provided in the clearance 70 and the control substrate 72, on a surface of the opening and closing cover 65.

Also, by combination of FIGS. 5B and 5C described above, both on a back surface of the control panel cover 66 provided in the clearance 70 and on a surface of the opening and closing cover 65, the antistatic cloth 76 may be provided.

The antistatic cloth 76 may be grounded (not shown).

The present invention can be applied to image forming apparatuses and electronic devices such as copying machines, facsimile machines, and printers.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electronic device comprising:

a display that displays at least a status of the device and is mounted on a control panel cover;

a controller that is provided on a back surface of the control panel cover below the display and controls the display; a heat source; a shield that shields the controller from the heat source; a singular opening that communicates with a space formed between the controller and the shield and allows air outside the device to flow in and out of the space through the singular opening; and a projection that is provided on at least one of the back surface of the control panel cover and a surface of the shield between the opening and the controller, projects toward the other, and is formed obliquely with respect to the singular opening.

2. The electronic device according to claim 1, further comprising an antistatic cloth for removing static electricity that is provided on at least one of the back surface of the control panel cover and a surface of the shield between the singular opening and the controller.

3. The electronic device according to claim 2, wherein the antistatic cloth is grounded.

4. The electronic device according to claim 1, wherein the singular opening opens downwardly in a direction of gravitational force.

5. The electronic device according to claim 2, wherein the singular opening opens downwardly in a direction of gravitational force.

6. The electronic device according to claim 3, wherein the singular opening opens downwardly in a direction of gravitational force.

7. An image forming apparatus comprising:

a display that displays a status of the apparatus and is mounted on a control panel cover;

a controller that is provided on a back surface of the control panel cover below the display and controls the display;

a fixing device including at least a heater;

a shield that shields the controller from the fixing device;

a singular opening that communicates with a space formed between the controller and the shield and allows air outside the apparatus to flow in and out of the space through the singular opening; and a projection that is provided on at least one of the back surface of the control panel cover and a surface of the shield between the opening and the controller, projects toward the other, and is formed obliquely with respect to the singular opening.

8. The electronic device according to claim 7, further comprising:

an antistatic cloth for removing static electricity that is provided on at least one of the back surface of the control panel cover and a surface of the shield between the singular opening and the controller.

9. An electronic device comprising:

a display that displays at least a status of the device and is mounted on a control panel cover;

a controller that is provided on a back surface of the control panel cover below the display and controls the display;

a heat source:

a shield that shields the controller from the heat source; and a singular opening that communicates with a space formed between the controller and the shield and allows air outside the device to flow in and out of the space though the singular opening.

* * * * *